US008201754B2

(12) United States Patent
Chang

(10) Patent No.: US 8,201,754 B2
(45) Date of Patent: Jun. 19, 2012

(54) FLUID INJECTOR WITH THERMAL LOAD CONTROL

(75) Inventor: David Y. Chang, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 384 days.

(21) Appl. No.: 12/630,055

(22) Filed: Dec. 3, 2009

(65) Prior Publication Data

US 2011/0132293 A1 Jun. 9, 2011

(51) Int. Cl.
*B05B 1/24* (2006.01)
*B05B 15/00* (2006.01)

(52) U.S. Cl. ..... 239/132; 239/132.3

(58) Field of Classification Search ..... 123/41.31; 239/132, 132.1, 132.3, 132.5
See application file for complete search history.

(56) References Cited

U.S. PATENT DOCUMENTS

| | | | | |
|---|---|---|---|---|
| 3,737,100 | A | 6/1973 | Dreisin | |
| 4,104,992 | A | 8/1978 | Fricker | |
| 4,471,909 | A | 9/1984 | Perr | |
| 4,700,891 | A | 10/1987 | Hans et al. | |
| 6,360,963 | B2 | 3/2002 | Popp | |
| 7,108,206 | B2 | 9/2006 | Yacoub et al. | |
| 7,383,794 | B2 * | 6/2008 | Hlousek et al. | 123/41.33 |
| 7,849,836 | B2 * | 12/2010 | Chang | 123/456 |
| 7,900,886 | B2 * | 3/2011 | Manubolu et al. | 251/129.16 |
| 2004/0007210 | A1 * | 1/2004 | Tian et al. | 123/456 |
| 2008/0295806 | A1 * | 12/2008 | Chang et al. | 123/470 |
| 2010/0006679 | A1 * | 1/2010 | Manubolu et al. | 239/585.5 |
| 2010/0077971 | A1 * | 4/2010 | Venkataraghavan et al. | 123/41.42 |
| 2010/0176223 | A1 * | 7/2010 | Venkataraghavan et al. | 239/585.1 |
| 2011/0056464 | A1 * | 3/2011 | Chang | 123/456 |

FOREIGN PATENT DOCUMENTS

| | | |
|---|---|---|
| DE | 102005009804 | 9/2006 |
| GB | 503432 | 4/1939 |
| JP | 3791190 | 6/2006 |

* cited by examiner

*Primary Examiner* — Thomas Moulis

(57) ABSTRACT

A common rail single fluid injection system includes fuel injectors and control valve assemblies with an internal cooling fluid circuit to improve overall life and performance of the injector. This is accomplished by supplying cooling fluid to the injector and allowing the same to come in direct contact with one of the hottest locations within the fuel injector; the high-pressure leak split spot. By providing cooling fluid directly to this location and then allowing the cooling fluid to drain out of the injector, the present disclosure effectively and efficiently manages thermal loads within the injector.

25 Claims, 4 Drawing Sheets

FLUID INJECTOR WITH THERMAL LOAD CONTROL

TECHNICAL FIELD

The present disclosure relates generally to a single fluid fuel injection system, and more particularly to a fuel injector and a control valve assembly capable of controlling thermal loads.

BACKGROUND

Engines, including diesel engines, gasoline engines, natural gas engines, and other engines known in the art, exhaust a complex mixture of combustion related constituents. The constituents may be gaseous and solid material, which include nitrous oxides (NOx) and particulate matter. Due to increased attention on the environment, exhaust emission standards have become more stringent and the amount of NOx and particulate matter emitted from an engine may be regulated depending on the type of engine, size of engine, and/or class of engine.

Engineers have come to recognize that common rail fuel systems may be used to improve diesel engine emissions and performance. Common rail fuel systems can provide high injection pressure, flexible injection modes, such as multiple injections, and may be operated independently of engine speed. However, because of the high pressures associated with common rail fuel systems, the same may have an increased risk of fuel leakage. Leakage of fuel at high pressures tends to generate heat, which is then transferred to the injector components. This heat may increase the temperature and may change the material properties of the injector components. In certain instances, the temperature may become high enough to cause fuel to decompose and become unstable or oxidated within the high-pressure fuel system. This may lead to fuel deposits being formed on injector components, such as control valves. These deposits may inhibit the movement of control valve components by causing the same to become sticky or stuck. This may lead to control valve failure and ultimately injector failure.

To meet increasingly stringent emissions regulations, engine manufacturers have utilized multiple injections of fuel into the combustion chamber during any particular combustion event. The multiple injections may include a pilot injection, a main injection, and/or a post injection. In most cases, multiple injections may be achieved by controlling the actuation of a control valve multiple times during any given combustion cycle. In order to achieve these multiple actuation events, additional electrical energy is required. The increased number of valve actuations may lead to more leakage of high-pressure fuel within the fuel injector. Increased leakage may further increase the internal temperature of an injector.

The use of multiple injection events and higher fuel pressures may have a significant impact on the magnitude of the heat energy to which components of fuel injections. One of the hottest locations within a fuel injector is the high-pressure leak split spot. This spot is located at or near the center of a control valve. Rising temperatures within a control valve may lead to failure of solenoids if the fuel injector is not cooled sufficiently. It would be desirable to cool a fuel injector in such a manner that the temperature of the high-pressure leak split spot is controlled.

An example of a previous attempt to cool a fuel injector is disclosed in U.S. Pat. No. 6,360,963 to Popp. In that disclosure, openings in the form of the cross holes are drilled into the sleeve of the needle chamber. These cross-holes are provided to allow gaseous fuel to cool the exposed surface of the needle valve. While this disclosure may work to keep the injector needle and tip cooler, it does nothing to address the temperature within the hottest location of the injector; the high-pressure leak split spot. Thus, the control valve may still be susceptible to failure due to excessive temperatures.

The disclosed fuel injector and control valve assembly with thermal load control is directed to overcoming one or more of the problems set forth above.

SUMMARY OF THE DISCLOSURE

In one aspect, a fluid injector including an injector body defining a cooling fluid supply inlet, a high-pressure fluid supply inlet, and a drain. The injector also includes a control valve assembly at least partially disposed within the injector body, and fluidly coupled to the high-pressure fluid supply inlet, the cooling fluid supply inlet, and the drain. The control valve further includes a valve body having an opening for receiving a valve stem. An electrical actuator at least partially disposed within the valve body is also included in the control valve. The control valve further includes an armature coupled to a valve stem, wherein the valve stem is at least partially disposed within the valve body. A load screw disposed above the valve body and having an opening for receiving a valve stem is also included. The control valve also includes a radial passage fluidly coupling a high-pressure leak split spot, the cooling fluid supply inlet, and the drain.

In another aspect, a method of cooling a fluid injector including the steps of providing an injector body defining a cooling fluid supply inlet, a high-pressure fluid supply inlet, and a drain. Also provided is a control valve assembly at least partially disposed within the injector body, fluidly coupled to the high pressure fluid supply inlet, the cooling fluid supply inlet, and the drain. The control valve further includes a valve body having an opening for receiving a valve stem. Also included is a valve stem at least partially disposed within the valve body. The control valve further includes a load screw having an opening for receiving a valve stem. The method also includes a step of supplying cooling fluid to a high-pressure leak split spot. A step of draining cooling fluid away from the high-pressure leak split spot and out of the injector is also a part of the method.

In another aspect, an internal combustion engine including an engine housing defining a plurality of engine cylinders, and including a plurality of pistons each being movable within a corresponding one of the engine cylinders. Also included is a fuel system having a plurality of fuel injectors associated one with each of the plurality of engine cylinders, each of the fuel injectors including an injector body and a control valve, wherein each injector body defines a cooling fluid supply inlet, a high pressure fuel supply inlet, and a drain. Each control valve assembly is at least partially disposed within the injector body, and is fluidly coupled to the high pressure fuel supply inlet, the cooling fluid supply inlet, and the drain, and further includes a valve body having an opening for receiving a valve stem. The control valve also includes an electrical actuator and an armature coupled to a valve stem, wherein the valve stem is at least partially disposed within the valve body. The control valve also includes a load screw disposed above the valve body and having an opening for receiving a valve stem. The control valve also includes a radial passage fluidly coupling a high-pressure leak split spot, the cooling fluid supply inlet, and the drain.

In another aspect, a control valve assembly including a cooling fluid supply, and a valve body having an opening for receiving a valve stem. The control valve assembly further includes an electrical actuator and an armature coupled to a valve stem, wherein the valve stem is at least partially disposed within the valve body. A load screw disposed above the valve body and having an opening for receiving a valve stem is also included. The control valve further includes a radial passage fluidly coupled to the cooling fluid supply and a high-pressure leak split spot.

DETAILED DESCRIPTION

Figure 1:
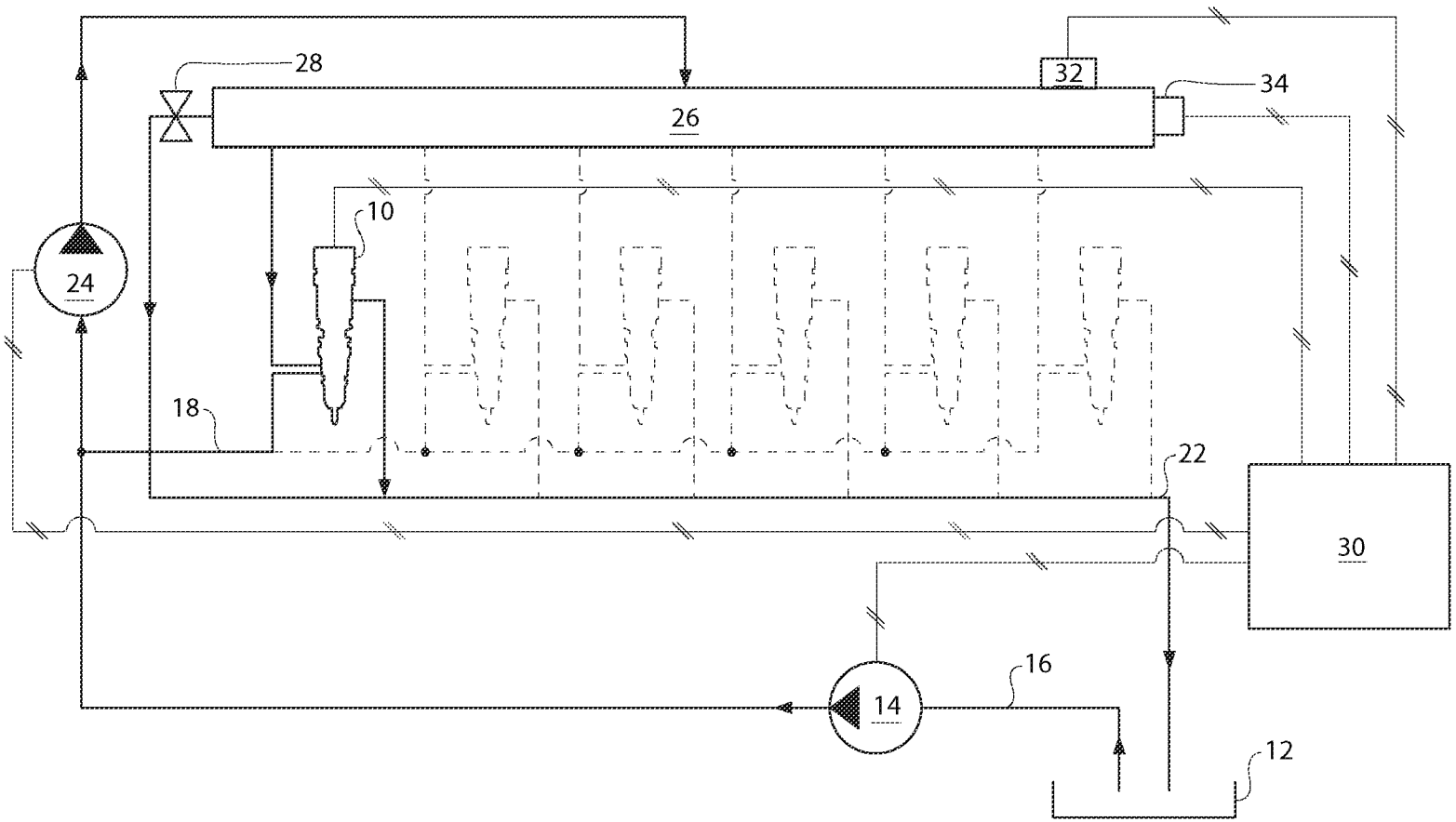
FIG. 1 is a diagrammatic schematic of a fuel system using a common rail fuel injector according the present disclosure.

Referring to FIG. 1, a fuel system utilizing a common rail fuel injector 10 is shown. A reservoir 12 contains fuel at an ambient pressure. A transfer pump 14 draws low-pressure fuel through fuel supply line 16 and provides it to a cooling fuel supply line 18. Cooling fuel supply line 18 provides low-pressure fuel to injectors 10 for cooling purposes. Those skilled in the art will recognize that cooling fuel can be supplied to the injectors either in parallel or in series without departing from the nature and scope of this disclosure. If cooling fuel is supplied in parallel, each injector receives cooling fluid directly from the reservoir 12. Alternatively, if cooling fuel is supplied in series, only the first injector receives cooling fuel from the reservoir. When that cooling fuel is drained, it is then supplied to the next injector in the series and so on down the line.

Within each injector 10, low-pressure fuel is routed through a cooling circuit (described in greater detail below) wherein low-pressure fuel is routed past a high-pressure leak split spot 20 (See FIGS. 2 and 3) and drained out of the injector 10. Drained fuel is ultimately returned to the reservoir 12 via a fuel return line 22.

Transfer pump 14 also provides low-pressure fuel to high-pressure pump 24. High-pressure pump 24 then pressurizes the fuel to desired fuel injection pressure levels and delivers the fuel to the fuel rail 26. The pressure in fuel rail 26 is controlled in part by safety valve 28, which spills fuel to the fuel return line 22 if the pressure in the fuel rail 26 is above a desired pressure. The fuel return line 22 returns fuel to reservoir 12.

Fuel injector 10 draws fuel from fuel rail 26 and injects it into a combustion cylinder of the engine (not shown). Fuel not injected by injector 10 is spilled to fuel return line 22. Electronic Control Module (ECM) 30 provides general control for the system. ECM 30 receives various input signals, such as from pressure sensor 32 and a temperature sensor 34 connected to fuel rail 26, to determine operational conditions. ECM 30 then sends out various control signals to various components including the transfer pump 14, high-pressure pump 24, and fuel injector 10.

Figure 2:
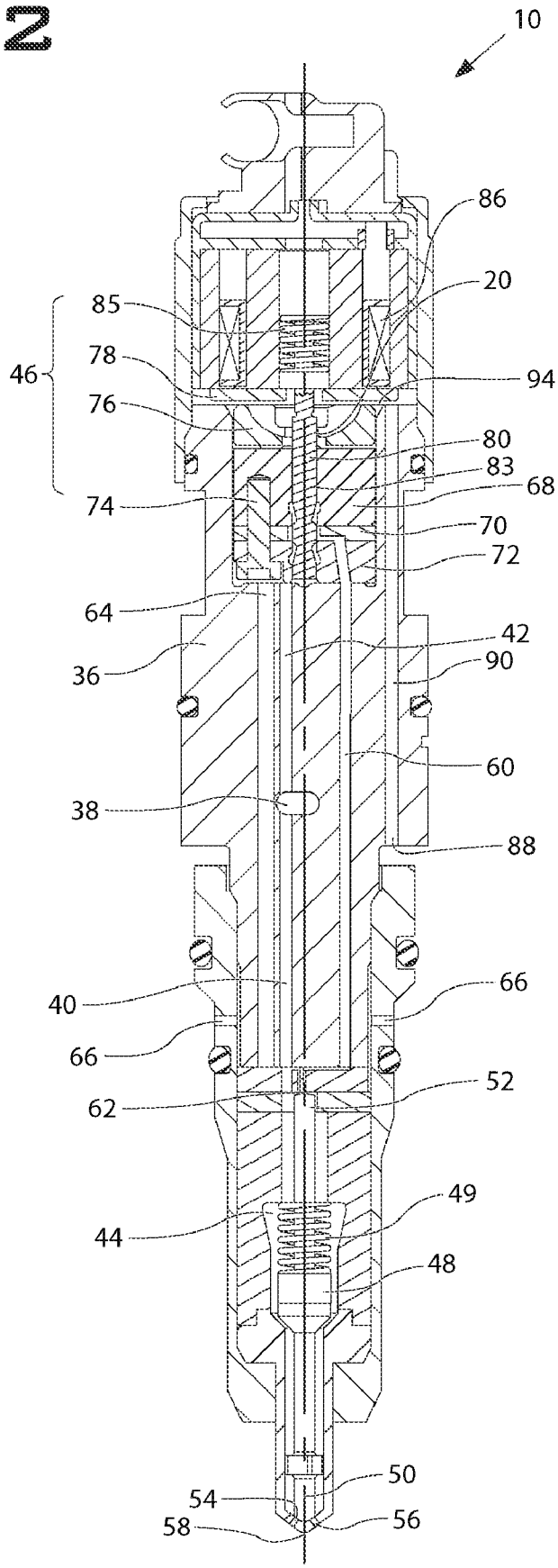
FIG. 2 is a cross section of a common rail fuel injector utilizing an exemplary control valve assembly with thermal load control according to present disclosure.

Referring to FIG. 2, the internal structure and fluid circuitry of each fuel injector 10 is illustrated. In particular, an injector body 36 defines a high-pressure fuel supply inlet 38 and a nozzle fuel supply passage 40 and a control valve supply passage 42 which are interconnected. Nozzle fuel supply passage 40 is in fluid communication with nozzle chamber 44. Control valve supply passage 42 is in fluid communication control valve assembly 46. Disposed within nozzle chamber 44 is a check needle 48. The check needle 48 has a first end 50 and a second end 52. The check needle 48 is movable between a first and second position. In a first position, the first end 50 of the check needle 48 rests on seat 54, which in a first position, rests on seat 54 and blocks at least one orifice 56 located in the injector tip 58. Biasing spring 49 biases check needle 48 toward its first position. As will be explained in greater detail below, in its second position, the first end 50 of the check needle 48 at least partially unblocks the at least one orifice 56, thereby allowing fuel to be injected into a combustion chamber (not shown).

Injector body 36 also defines a check control passage 60. Check control passage 60 is in fluid communication with check control chamber 62. The second end 52 of check needle 49 is disposed within the check control chamber 62. The check control passage 60 is also in selective fluid communication with control valve supply passage 42, via control valve assembly 46. Control valve assembly 46 may also selectively put check control passage 60 in fluid communication with a drain passage 64 and drain outlets 66.

Figure 3:
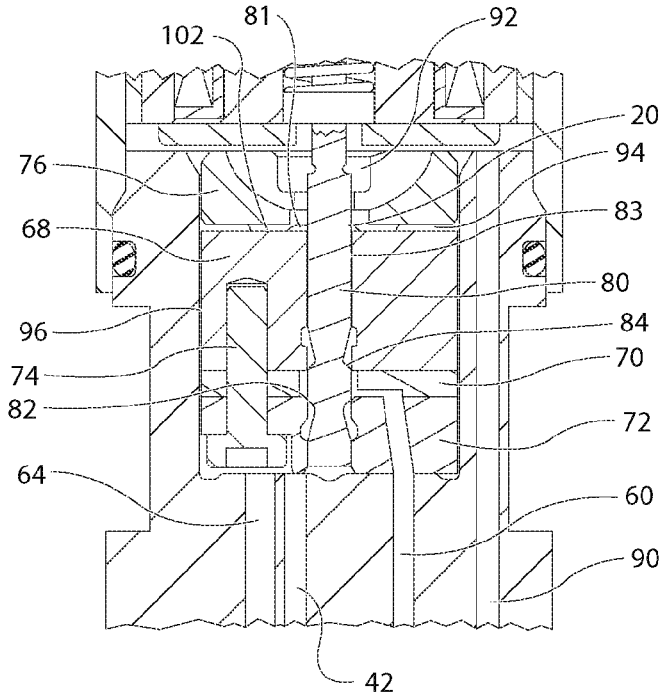
FIG. 3 is a detail view of an exemplary control valve assembly according to the present disclosure.
Figure 4:
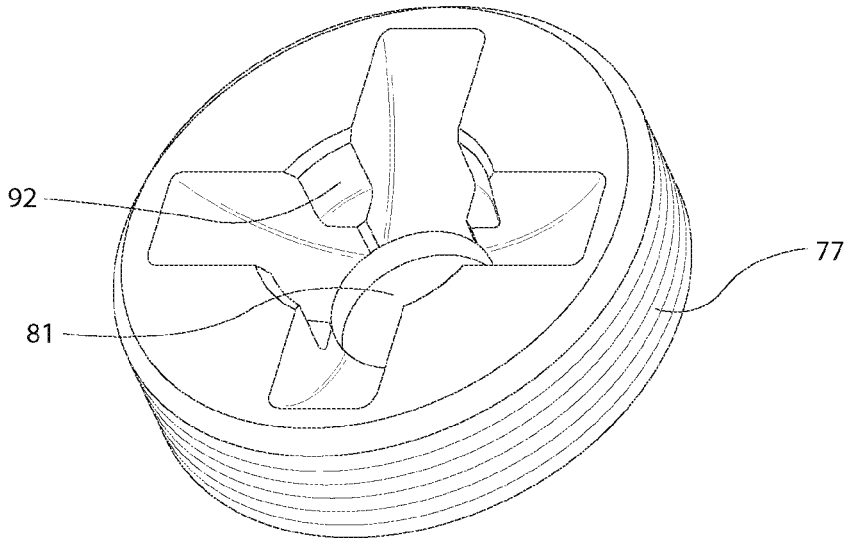
FIG. 4 is a plan view of the upper surface of an exemplary load screw according to the present disclosure.
Figure 5:
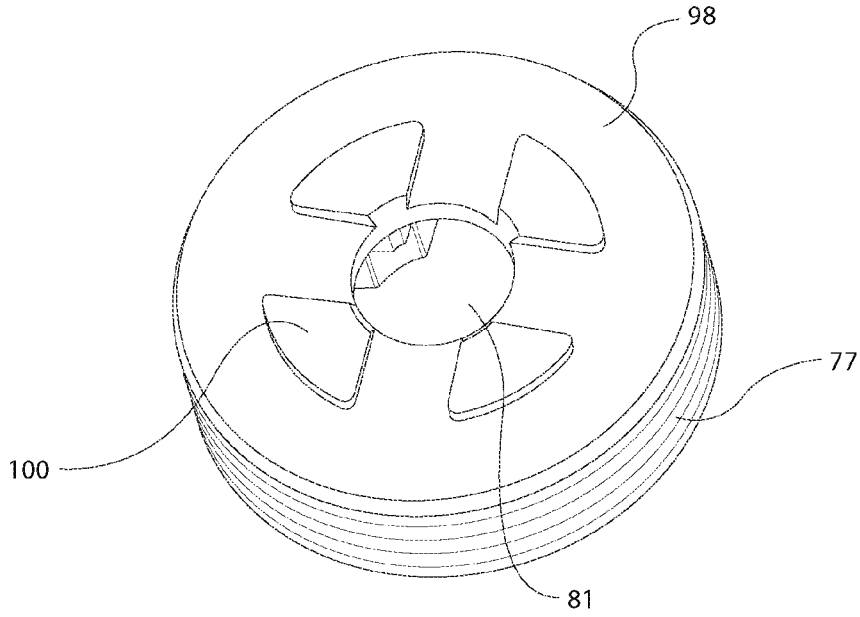
FIG. 5 is a plan view of the lower surface of an exemplary load screw according to the present disclosure.
Figure 6:
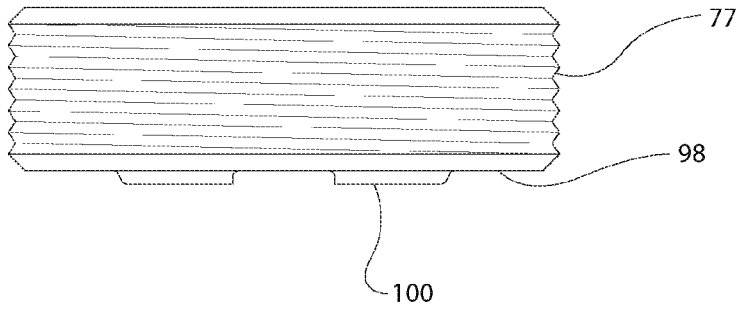
FIG. 6 is a side view of an exemplary load screw according to the present disclosure.

The operation of the fuel injector 10 is controlled at least in part by control valve assembly 46. As seen in FIGS. 2 and 3, at least a portion of control valve assembly 46 may be disposed within the injector body 36 of injector 10. Control valve assembly 46 may include an upper valve body 68, a lift plate 70, and a lower valve body 72. The upper valve body 68, lift plate 70, and lower valve body 72 may be held together by a securing mechanism or screw 74. The control valve assembly 46 may further comprise a load screw 76. The load screw 76 is disposed atop the upper valve body 68 and may have threaded sides 77 to allow it to be screwed into mating threads (not shown) on the injector body. When in position, the load screw 76 applies a downward force on the upper valve body 68, lift plate 70, and lower valve body 72, thereby minimizing their movement within injector body 36.

Control valve assembly 46 may further include an armature 78 coupled to a valve stem 80. Armature 78 may be disposed atop the load screw 76. Valve stem 80 may be disposed within an opening that extends through the load screw 76, upper valve body 68, lift plate 70, and lower valve body 72. Valve stem 80 may be movable between a low-pressure seat 82 and a high-pressure seat 84. A biasing spring 85 biases valve stem 80 toward the low-pressure seat 82. When valve stem 80 is on the low-pressure seat 82, check control passage 60 is in fluid communication with control valve supply passage 42. Conversely, when valve stem 80 is on the high-pressure seat 84, check control passage 60 is in fluid communication with drain passage 64.

Control valve assembly 46 may further include an electrical actuator 86. The electrical actuator 86 depicted in FIGS. 2 and 3 is a solenoid. However, those skilled in the art will recognize that other types of electrical actuators, such as piezoelectric devices may be used without departing from the scope of this disclosure.

The operation of injector 10 will now be explained. The opening and closing of check needle 48 is controlled in part the presence of high pressure fuel in nozzle fuel supply passage 40, and the check control passage 60. Biasing spring 49 also plays a role in opening and closing of check needle 48. When an injection event is not desired, the electrical actuator 86 of control valve assembly 46 is not energized. High-pressure fuel enters injector 10 through high-pressure fuel inlet 26. Pressurized fuel is provided to control valve assembly 46, via control valve supply passage 42. In its deenergized state, control valve assembly 46 provides fluid communication between control valve supply passage 42 and check control passage 60. Thus, high-pressure fuel from check control passage 60 provides a hydraulic load on the second end 52 of check needle 48. The hydraulic load will keep check needle 48 closed such that the first end 50 of check needle 48 maintains contact with seat 54 and no fuel is injected out of orifice 56.

When injection is desired, the electrical actuator 86 of control valve assembly 46 is energized. The electrical actuator depicted in FIGS. 2 and 3 is a solenoid. Thus, when energized, electrical actuator 86 creates an electromagnetic field, which causes armature 78 to overcome the force of biasing spring 85 and lift. Valve stem 80, which is coupled to armature 78, is then moved to its upper position or high-pressure seat 84. In this position, pressurized fuel from control valve supply passage 42 is no longer in fluid communication with check control passage 60. Instead, check control passage 60 is in fluid communication with drain passage 64. High-pressure fuel is thus drained out of the check control passage 60 and the hydraulic load that was applied to the second end 52 of check needle 48 begins to decay. As the hydraulic load is decayed high pressure fuel from nozzle fuel supply passage 40 will apply hydraulic forces to the surfaces of the check needle 48 causing the same to open and begin to inject fuel into an engine cylinder (not shown).

When it is desirable to stop injection, electrical actuator 86 is deenergized. As the electromagnetic field generated by electrical actuator 86 dissipates, the force of biasing spring 85 acts on armature 78, and valve stem 80 is returned to close the low-pressure seat 82. When the valve stem 80 is on the low-pressure seat 82, the check control passage 60 is again in fluid communication with the control valve supply passage 42. Ultimately, a hydraulic load is once again applied on second end 52 of check needle 48. Thus, the first end 50 of check needle 48 is forced back into contact with seat 54 and orifice 56 is blocked.

During an injection event, when valve stem 80 is on the high-pressure seat 84, high-pressure fuel may tend to leak. Exemplary pressures of fuel that may leak may be up to and in excess of 190 MPa. At these high pressures, the fuel that leaks tends to migrate toward areas in the injector where the pressure is lower. One such location is known as the high-pressure leak split spot 20. This location may be defined generically as any location along the valve stem that leaking pressurized fuel migrates to. Specifically, as depicted in FIGS. 2 and 3, the high-pressure leak split spot may be defined as the interface between the upper valve body 68, load screw 76, and the valve stem 80. Thus, pressurized that leaks from the high-pressure seat 84, may migrate through the upper valve body 68 to the high-pressure leak split spot.
Leakage of fuel that occurs at these elevated pressures tends to generate excessive heat. This heat may be transferred to other injector components including the valve stem 80 and the electrical actuator 86. Excessive heat transferred to injector components increases their temperature, and may change component material properties. Thus, injector performance and life may be adversely affected.

Although not quite as common, leakage of high-pressure fuel may also occur when valve stem 80 is on the low-pressure seat 82. Thus, high-pressure fuel may leak when fuel from the control valve supply passage 42 is in fluid communication with check control passage 60. This high-pressure fuel may also migrate up the valve stem 80 through the upper valve body 68 to the high-pressure leak split spot 20. This leakage may also generate excessive heat and have adverse affects on injector components and performance.

A cooling system within individual fuel injectors 10 may be useful in combating excessive temperatures and controlling injector component temperatures. Injector body 36 may further define a cooling fluid inlet 88 coupled to a cooling fluid supply passage 90. Cooling fluid supply passage 90 routes relatively cool low-pressure fuel to the control valve assembly 46 to keep the temperature of injector 10 down. Specifically, cooling fluid supply passage 90 provides relatively cool low-pressure fuel to a load screw reservoir 92. The load screw reservoir 92 may be a bowl shaped receptacle defined by the load screw 76. The load screw reservoir 92 has an opening 81 in which valve stem 80 is disposed.

The cooling fuel that is supplied to the load screw reservoir 92 seeps down the sides 83 of valve stem 80 to the high-pressure leak split spot 20. The high-pressure leak split spot may often be the hottest location within the fuel injector 10. By routing low pressure cooling fuel directly to this location, thermal load control within the injection 10 is effectively and efficiently managed. Excessive heat from the high-pressure leak split spot 20 is transferred to the low pressure cooling fuel that is supplied thereto. This low pressure cooling fuel then travels through a radial passage 94 to an annular clearance 96, which may be defined as the space between the injector body 36 outer edges of the upper valve body 68, lift plate 70 and lower valve body 72. The radial passage 94 and annular clearance 96 are in fluid communication with drain passage 64. Thus, the low pressure cooling fuel is ultimately drained out of injector 10 through drain passage 64 and drain outlets 66.

Radial passage 94 carries low pressure cooling fuel away from the high-pressure leak split spot 20. It is thus sized to effectively carry away at least as much mass flow of cooling fuel as is provided thereto. Additionally, radial passage 94 may be formed in a variety of manners so long as it provides fluid communication between the low-pressure fuel inlet 90, the high-pressure leak split spot 20, drain passage 64, and drain outlets 66.

For example, as depicted in FIGS. 2, 3, 5 and 6, the lower surface 98 of load screw 76 may have one or more protrusions 100. These protrusions 100 prevent the lower surface 98 of the load screw 76 from resting flush against an upper surface 102 of the upper valve body 68. Instead, the protrusions 100 of load screw 76 are in contact with upper surface 102. In this manner, radial passage 94 is created by the space between the lower surface 98 of load screw 76 and the upper surface 102 of upper valve body 68. Although not shown, those skilled in the art will recognize that radial passage 94 may alternatively be formed if protrusions are disposed on the upper surface 102 of upper valve body 68. Likewise the radial passage 94 may also be formed if protrusions are disposed on both the lower surface 98 of the load screw 76 and the upper surface 102 of the upper valve body 68.

Radial passage 94 may alternatively be formed without protrusions. For example, one or more channels or radial indentations could be cut into surfaces 98 and/or 102. These channels or radial indentations would run along either or both surfaces 98 and 102 from the high-pressure leak split spot 20 to the annular clearance 96. Further, the channels or radial indentations would be sized such that they could effectively handle the flow of low pressure cooling fuel provided thereto by the cooling fluid supply passage 90. In yet another embodiment, radial passage 94 may be formed by drilled holes that run from the high-pressure leak split spot 20 through either the load screw 76, or one or more of the upper valve body 68, lift plate 70, and lower valve body 72.

Industrial Applicability

The present disclosure finds a preferred application in common rail fuel injection systems. In addition, the present disclosure finds preferred application in single fluid, namely fuel injection systems. Although the disclosure is illustrated in the context of a compression ignition engine, the disclosure could find application in other engine applications, including but not limited to spark ignited engines. The disclosed fuel injectors reduce the operating temperature of fuel injectors by utilizing a cooling system that directs cooling fuel to the high-pressure leak split spot, one of the hottest locations within an injector. In so doing, consistent reliable operation of injector components is achieved.

In a preferred embodiment, fuel injector 10 receives low-pressure fuel cooling fuel via the cooling fuel supply line 18 and transfer pump 14. This cooling fuel comes into injector 10 at the cooling fluid inlet 88. The cooling fluid inlet 88 is fluidly coupled to a cooling fluid supply passage 90. Cooling fluid supply passage 90 runs from the cooling fluid inlet 88 through the injector body 36 to the control valve assembly 46. Specifically, the cooling fluid supply passage 90 provides cooling fuel to load screw reservoir 92. Valve stem 80 is also disposed within the load screw reservoir 92. Cooling fuel is allowed to run down the sides 83 of valve stem 80 until it reaches the high-pressure leak split spot 20. The high-pressure leak split spot is one of the hottest locations within the injector 10. Cooling fuel provided to the high-pressure leak split spot then travels along a radial passage 94 to an annular clearance 96. From there, cooling fuel is routed to drain passage 64 and out of the injector 10 via drain outlets 66. From there, the cooling fluid is ultimately returned to the reservoir 12.

The injector of the present disclosure controls thermal load within a common rail fuel injector by utilizing the aforementioned internal cooling circuit. In so doing, the control valve assembly 46 is cooled as is the high-pressure leak split spot 20, which is one of the hottest locations within the injector. By providing cooling fuel directly to the high-pressure leak split spot, the injector of the present disclosure provides for an effective transfer of thermal energy. For example, laboratory tests have shown that injectors that do not utilize the cooling method as described in this disclosure may operate at temperatures between 150-160° C., while injectors that utilize the disclosed method may operate at 100-110° C. By operating at a significantly lower temperature, a more consistent and reliable injector performance can be achieved.

The above description is intended for illustrative purposes only and is not intended to limit the scope of the present disclosure in any way. Thus, those skilled in the art will appreciate the various modifications that can be made to the illustrated embodiments without departing from the spirit and scope of the disclosure, which is defined in the terms of the claims set forth below.

What is claimed is:

1. A fluid injector comprising:

an injector body defining a cooling fluid supply inlet, a high-pressure fluid supply inlet, and a drain; and a control valve assembly at least partially disposed within the injector body, fluidly coupled to the high-pressure fluid supply inlet, the cooling fluid supply inlet, and the drain, and further comprising:

a valve body having an opening for receiving a valve stem;

an electrical actuator at least partially disposed within the valve body;

an armature coupled to a valve stem, wherein the valve stem is at least partially disposed within the valve body; and a load screw disposed above the valve body and having an opening for receiving a valve stem; and a radial passage fluidly coupling a high pressure leak split spot, the cooling fluid supply inlet, and the drain.

2. The fluid injector of claim 1, wherein the opening within the load screw further forms a load screw reservoir that is fluidly coupled to the low-pressure fluid supply inlet, the high-pressure leak split spot, the radial passage, and the drain.

3. The fluid injector of claim 2, wherein the injector body further defines a cooling passage that fluidly couples the low-pressure fluid supply inlet and the load screw reservoir.

4. The fluid injector of claim 3, wherein the load screw further includes threads on an outer peripheral surface, and the injector body further includes mating threads that allow the load screw to be secured in position within the injector body.

5. The fluid injector of claim 4, wherein the valve body is an upper valve body and the control valve assembly further includes a lower valve body, a lift plate, wherein the lift plate is disposed between the upper and lover valve body and each of the upper valve body, lower valve body and lift plate have an opening for receiving a valve stem.

6. The fluid injector of claim 5, wherein the load screw has at least one protrusion disposed on a lower surface thereof that is in contact with an upper surface of the upper valve body and wherein the space between the upper valve body and the load screw forms the radial passage.

7. The fluid injector of claim 5, wherein the upper valve body has at least on protrusion disposed on an upper surface thereof that is in contact with a lower surface of the load screw and wherein the space between the upper valve body and the load screw forms the radial passage.

8. The fluid injector of claim 5, wherein the radial passage is formed by a drilled hole in at least one of the load screw, upper valve body, lift plate and lower valve body.

9. A method of cooling a fluid injector comprising the steps of:

providing an injector body defining a cooling fluid supply inlet, a high pressure fluid supply inlet, and a drain; and providing a control valve assembly at least partially disposed within the injector body, fluidly coupled to the high pressure fluid supply inlet, the cooling fluid supply inlet, and the drain, and further comprising:

a valve body having an opening for receiving a valve stem;

a valve stem at least partially disposed within the valve body;

a load screw having an opening for receiving a valve stem;

supplying cooling fluid to a high pressure leak split spot; and draining cooling fluid away from the high-pressure leak split spot and out of the injector.

10. The method of claim 9, wherein the supplying step is facilitated by a passage defined by the injector body that fluidly couples the cooling fluid supply inlet, a load screw reservoir formed within the load screw, and the high-pressure leak split spot.

11. The method of claim 10, wherein the draining step is facilitated by a radial passage that fluidly couples the high-pressure leak split spot, a drain passage within the injector and the drain.

12. An internal combustion engine comprising:

an engine housing defining a plurality of engine cylinders, and including a plurality of pistons each being movable within a corresponding one of the engine cylinders; and a fuel system including a plurality of fuel injectors associated one with each of the plurality of engine cylinders, each of the fuel injectors including an injector body and a control valve;

wherein each injector body defines a cooling fluid supply inlet, a high pressure fuel supply inlet, and a drain; and wherein each control valve assembly is at least partially disposed within the injector body, and is fluidly coupled to the high pressure fuel supply inlet, the cooling fluid supply inlet, and the drain, and further comprises:

a valve body having an opening for receiving a valve stem;

an electrical actuator;

an armature coupled to a valve stem, wherein the valve stem is at least partially disposed within the valve body; and a load screw disposed above the valve body and having an opening for receiving a valve stem; and a radial passage fluidly coupling a high-pressure leak split spot, the cooling fluid supply inlet, and the drain.

13. The internal combustion engine of claim 12, wherein the opening within the load screw further forms a load screw reservoir that is fluidly coupled to the cooling fluid supply inlet, the high-pressure leak split spot, the radial passage, and the drain.

14. The internal combustion engine of claim 13, wherein the injector body further defines a cooling passage that fluidly couples the low-pressure fuel inlet and the load screw reservoir.

15. The internal combustion engine of claim 14, wherein the load screw further includes threads on an outer peripheral surface, and the injector body further includes mating threads that allow the load screw to be secured in position within the injector body.

16. The internal combustion engine of claim 15, wherein the valve body is an upper valve body and the control valve assembly further includes a lower valve body, a lift plate, wherein the lift plate is disposed between the upper and lover valve body and each of the upper valve body, lower valve body and lift plate have an opening for receiving a valve stem.

17. The internal combustion engine of claim 16, wherein the load screw has at least one protrusion disposed on a lower surface thereof that is in contact with an upper surface of the upper valve body and wherein the space between the upper valve body and the load screw forms the radial passage.

18. The internal combustion engine of claim 16, wherein the upper valve body has at least on protrusion disposed on an upper surface thereof that is in contact with a lower surface of the load screw and wherein the space between the upper valve body and the load screw forms the radial passage.

19. The internal combustion engine of claim 16, wherein the radial passage is formed by a drilled hole in at least one of the load screw, upper valve body, lift plate and lower valve body.

20. A control valve assembly comprising:

a cooling fluid supply;

a valve body having an opening for receiving a valve stem;

an electrical actuator;

an armature coupled to a valve stem, wherein the valve stem is at least partially disposed within the valve body;

a load screw disposed above the valve body and having an opening for receiving a valve stem; and a radial passage fluidly coupled to the cooling fluid supply and a high-pressure leak split spot.

21. The control valve assembly of claim 9, wherein the opening within the load screw further forms a load screw reservoir that is fluidly coupled to the cooling fluid supply, the high-pressure leak split spot, and the radial passage.

22. The control valve assembly of claim 21, wherein the valve body is an upper valve body and the control valve assembly further includes a lower valve body, a lift plate, wherein the lift plate is disposed between the upper and lover valve body and each of the upper valve body, lower valve body and lift plate have an opening for receiving a valve stem.

23. The control valve assembly of claim 22, wherein the load screw has at least one protrusion disposed on a lower surface thereof that is in contact with an upper surface of the upper valve body and wherein the space between the upper valve body and the load screw forms the radial passage.

24. The control valve assembly of claim 22, wherein the upper valve body has at least on protrusion disposed on an upper surface thereof that is in contact with a lower surface of the load screw and wherein the space between the upper valve body and the load screw forms the radial passage.

25. The control valve assembly of claim 22, wherein the radial passage is formed by a drilled hole in at least one of the load screw, upper valve body, lift plate and lower valve body.

* * * * *